US011779113B2

(12) United States Patent
Chavan et al.

(10) Patent No.: US 11,779,113 B2
(45) **Date of Patent: *Oct. 10, 2023**

(54) TRIM ASSEMBLY FOR AN APPLIANCE SHELF

(71) Applicant: WHIRLPOOL CORPORATION, Benton Harbor, MI (US)

(72) Inventors: Pratik P. Chavan, Pune (IN); Shrawan Kumar, St. Joseph, MI (US); Pranav Karan, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/473,122

(22) Filed: Sep. 13, 2021

(65) Prior Publication Data

US 2021/0401174 A1 Dec. 30, 2021

Related U.S. Application Data

(62) Division of application No. 16/811,546, filed on Mar. 6, 2020, now Pat. No. 11,140,985.

(60) Provisional application No. 62/833,822, filed on Apr. 15, 2019.

(51) Int. Cl.
*A47B 96/02* (2006.01)
*F25D 25/02* (2006.01)

(52) U.S. Cl.
CPC ..... *A47B 96/021* (2013.01); *F25D 25/02* (2013.01); *F25D 2400/18* (2013.01)

(58) Field of Classification Search
CPC .... A47B 96/021; F25D 25/02; F25D 2400/18
USPC ..... 312/408
See application file for complete search history.

(56) References Cited

U.S. PATENT DOCUMENTS

| | | | |
|---|---|---|---|
| 3,329,281 | A | 7/1967 | Ball |
| 3,637,085 | A | 1/1972 | Ball |
| 4,373,448 | A | 2/1983 | Pallotta |
| 4,736,997 | A | 4/1988 | Besore et al. |
| 4,923,260 | A | 5/1990 | Poulsen |
| 4,960,308 | A | 10/1990 | Donaghy |
| 5,096,753 | A | 3/1992 | McCue et al. |
| 7,300,121 | B2 | 11/2007 | Diebold et al. |
| 8,684,479 | B2 | 4/2014 | Bai et al. |
| 9,823,013 | B1 | 11/2017 | Caglin et al. |
| 9,945,601 | B1 | 4/2018 | Bhavsar et al. |

(Continued)

FOREIGN PATENT DOCUMENTS

| | | | |
|---|---|---|---|
| WO | 2009136078 | A2 | 11/2009 |
| WO | 2018204215 | A1 | 11/2018 |

*Primary Examiner* — James O Hansen
(74) *Attorney, Agent, or Firm* — Price Heneveld LLP

(57) ABSTRACT

An appliance includes a cabinet that has an inner surface. A frame is coupled to the inner surface of the cabinet. The frame includes a frame boss that extends from a bottom surface thereof. A panel is positioned within the frame. The frame extends along a perimeter of the panel. An inner trim member has a flange that extends therefrom. The flange defines an aperture configured to align with the frame boss. A fastener is configured to extend through the aperture and engage the frame boss to couple the inner trim member with the frame. An outer trim member is disposed over the inner trim member. The inner trim member is configured to slidably receive the outer trim member.

14 Claims, 8 Drawing Sheets

(56) References Cited

U.S. PATENT DOCUMENTS

2019/0113273 A1* 4/2019 Kumar ..... A47B 96/021

* cited by examiner

TRIM ASSEMBLY FOR AN APPLIANCE SHELF

CROSS-REFERENCE TO RELATED APPLICATION

This application is a divisional application of U.S. patent application Ser. No. 16/811,546, filed Mar. 6, 2020, now U.S. Pat. No. 11,140,985, and entitled "TRIM ASSEMBLY FOR AN APPLIANCE SHELF," which claims priority to and the benefit under 35 U.S.C. § 119(e) of U.S. Provisional Patent Application No. 62/833,822, filed on Apr. 15, 2019, entitled "TRIM ASSEMBLY FOR AN APPLIANCE SHELF", the entire disclosures of which are hereby incorporated herein by reference.

FIELD OF THE DISCLOSURE

The present disclosure generally relates to a trim assembly, and more specifically, to a two-piece trim assembly for an appliance shelf.

BACKGROUND OF THE DISCLOSURE

Appliance shelves often include a trim feature for improving the aesthetics of the shelf and the appliance. The trim features are typically disposed along front portions of the shelves. Often, the trim feature is attached to the front of the shelf via adhesive.

SUMMARY OF THE DISCLOSURE

According to one aspect of the present disclosure, an appliance includes a cabinet that has an inner surface. A frame is coupled to the inner surface of the cabinet. The frame includes a frame boss that extends from a bottom surface thereof. A panel is positioned within the frame. The frame extends along a perimeter of the panel. An inner trim member has a flange that extends therefrom. The flange defines an aperture configured to align with the frame boss. A fastener is configured to extend through the aperture and engage the frame boss to couple the inner trim member with the frame. An outer trim member is disposed over the inner trim member. The inner trim member is configured to slidably receive the outer trim member.

According to another aspect of the present disclosure, a shelf assembly for an appliance includes a panel that has a first edge. A frame extends along at least the first edge. The frame defines a first cutout and a second cutout spaced-apart from one another. An inner trim member is coupled to the frame. The inner trim member includes a flange configured to extend through the first cutout and a trim boss configured to extend through the second cutout. An outer trim member is configured to be slidably received by the inner trim member.

According to another aspect of the present disclosure, a trim assembly for a shelf includes an inner member that defines a trim boss extending therefrom. The inner member defines a locking feature. An outer member is configured to slidably receive the inner member. The outer member defines a notch. The locking feature is configured to form an interlocking connection with the outer member when disposed within the notch. A frame defines a cutout. The trim boss is disposed in the cutout.

These and other features, advantages, and objects of the present disclosure will be further understood and appreciated by those skilled in the art by reference to the following specification, claims, and appended drawings.

Figure 1:
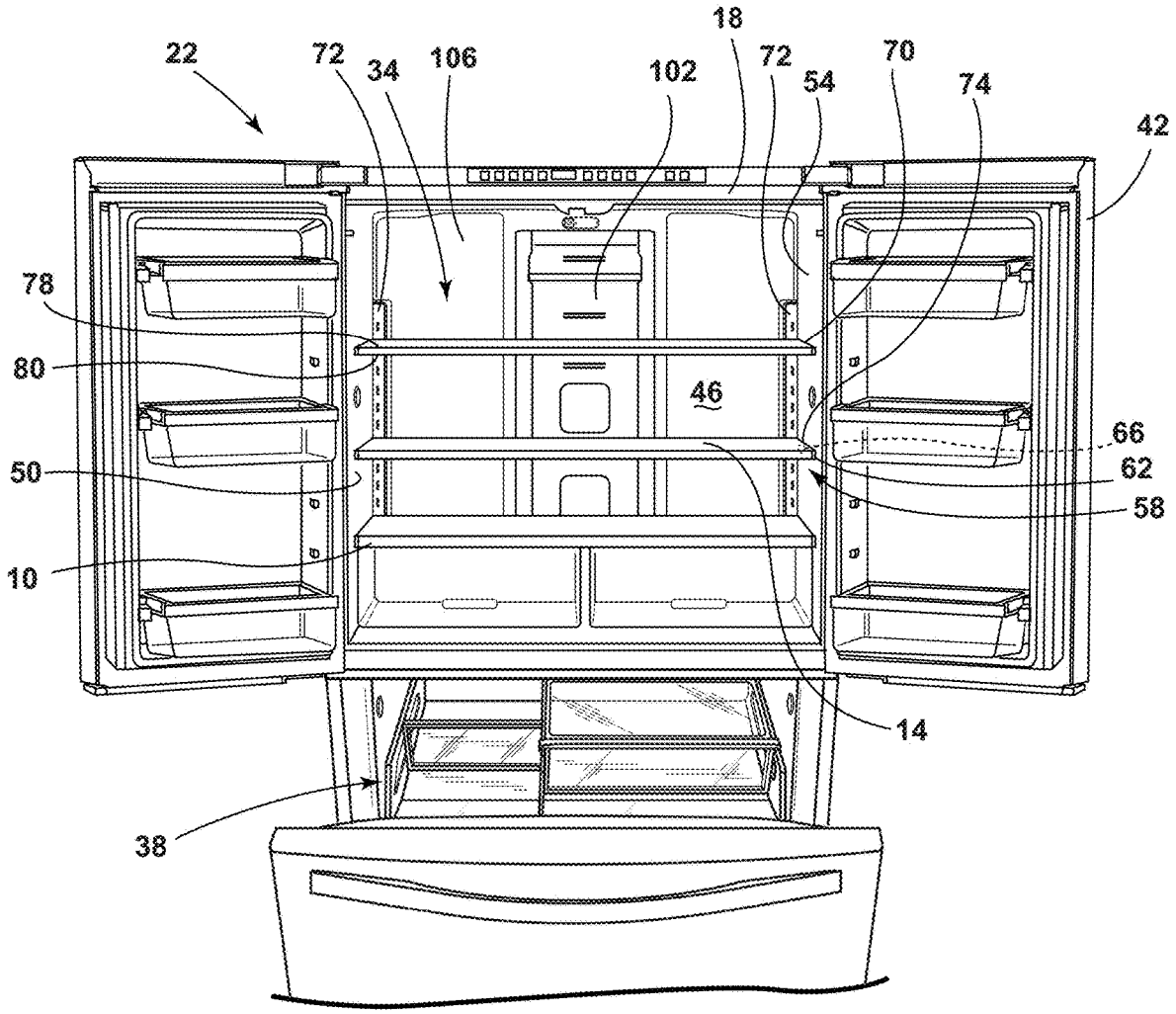
FIG. 1 is a partial front perspective view of a refrigerator compartment of a refrigerator, according to at least one example.

The components in the figures are not necessarily to scale, emphasis instead being placed upon illustrating the principles described herein.

DETAILED DESCRIPTION

The present illustrated embodiments reside primarily in combinations of method steps and apparatus components related to a trim assembly for an appliance shelf. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-13, reference numeral 10 generally designates a two-piece trim assembly coupled to a shelf 14. The shelf 14 is positioned within a cabinet 18 of an appliance, such as a refrigerator 22. The two-piece trim assembly 10 includes an outer member 26 and an inner member 30, and the inner member 30 is configured to slidably receive and retain the outer member 26.

Referring to FIG. 1, the refrigerator 22 includes the cabinet 18, which typically includes a refrigerator compartment 34 and/or a freezer compartment 38. The refrigerator 22 is illustrated as a French door bottom mount refrigerator. However, it is contemplated that the refrigerator 22 may be, for example, a bottom mount refrigerator, a top mount refrigerator, a side-by-side refrigerator, a 4-door French door refrigerator, and/or a 5-door French door refrigerator. The refrigerator 22 includes at least one door 42 and is coupled to the cabinet 18. The doors 42 are operable between opened and closed positions to access and enclose the refrigerator and/or freezer compartments 34, 38, respectively.

The shelf 14 is positioned within the cabinet 18 and is coupled to an inner surface 46 of the cabinet 18. In various examples, the shelf 14 is coupled to first and second sidewalls 50, 54 of the cabinet 18 to extend across the entire refrigerator compartment 34. It is contemplated that the shelf 14 may be coupled to the first sidewall 50 and be free from a direct mechanical connection with the second sidewall 54. The refrigerator 22 can include a single shelf 14 or can include more than one shelf 14. The shelves 14 may be positioned within the refrigerator compartment 34, the freezer compartment 38, and/or a combination thereof. In various examples, the shelf 14 can be positioned on the door 42 without departing from the teachings herein. While the two-piece trim assembly 10 is illustrated within the refrigerator 22, it is contemplated that the two-piece trim assembly 10 may be included in other appliances and storage containers. For example, the two-piece trim assembly 10 can be included in dishwashers, ovens, countertop appliances, refrigerated appliances, freezers, and other appliances in residential or commercial settings.

Still referring to FIG. 1, the shelf 14 may be coupled to the cabinet 18 in a variety of ways. For example, the shelf 14 can be removably coupled to the cabinet 18 via a track assembly 58. The track assembly 58 includes a track 62 positioned on and/or defined by at least one of the first and second sidewalls 50, 54 of the cabinet 18. In such examples, the shelf 14 includes a roller 66 configured to engage the track 62.

In a non-limiting example, the shelf 14 can be fixedly coupled to the cabinet 18 via fasteners 70. The fasteners 70 may include, for example, bolts, screws, pins, and other similar coupling members. Additionally or alternatively, one or more fixing features 72 can be coupled to the cabinet 18. The shelf 14 can be coupled to the fixing features 72 via the fasteners 70 or other coupling members, such as hooks.

Further, in an additional non-limiting example, the shelf 14 may be rotatably coupled to at least one of the first and second sidewalls 50, 54 of the cabinet 18 via a hinge assembly 74. In such examples, the shelf 14 is operable between a stowed position and a deployed position. The stowed position is typically substantially vertical. A top surface 78 or a bottom surface 80 of the shelf 14 can abut the inner surface 46 of the cabinet 18 in the stowed position. The deployed position is typically substantially horizontal, such that the shelf 14 extends outward from the inner surface 46 of the cabinet 18 into the refrigerator compartment 34.

Figure 2:
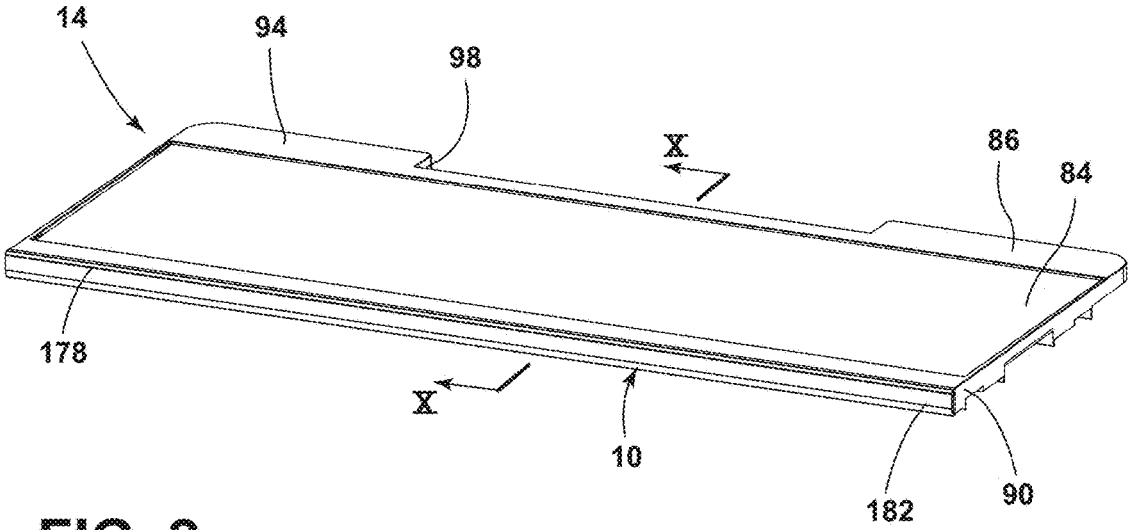
FIG. 2 is a top perspective view of a shelf having a two-piece trim assembly, according to at least one example.
Figure 3:
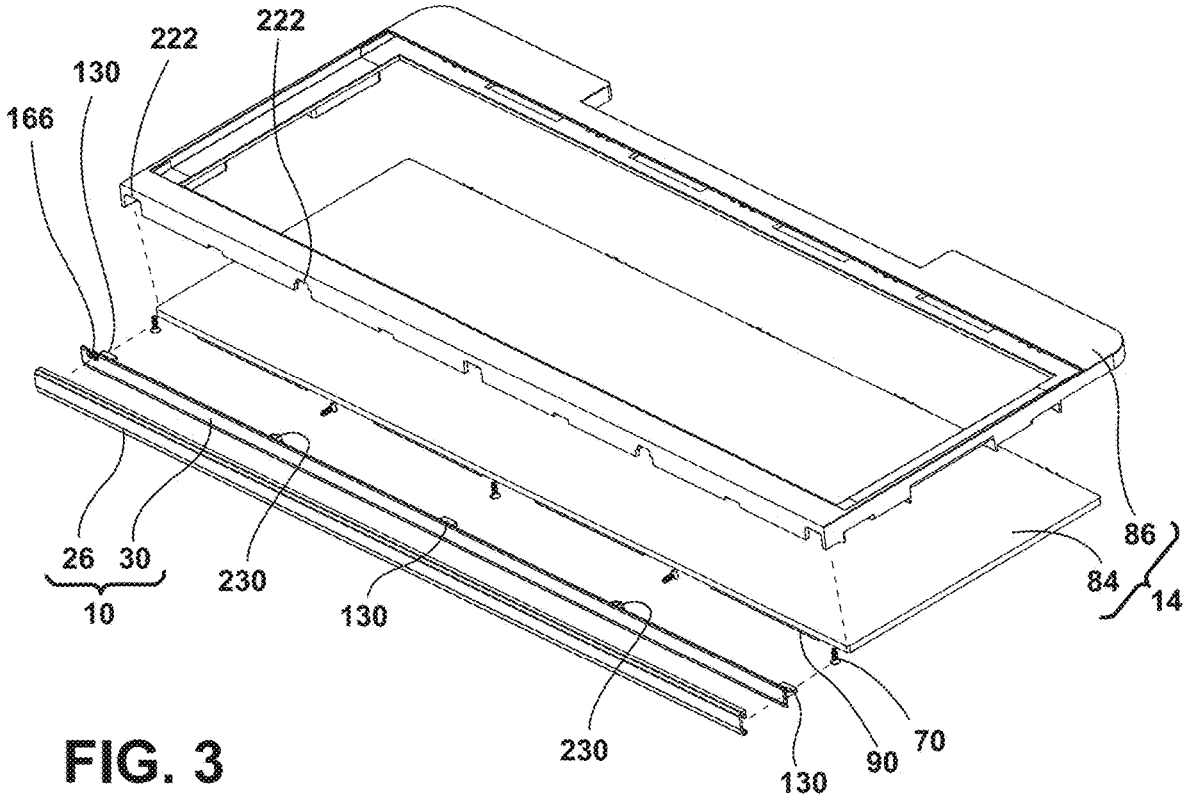
FIG. 3 is an exploded perspective view of the shelf having the two-piece trim assembly, according to at least one example.

Referring to FIGS. 1-3, the shelf 14 typically includes a panel 84 and a frame 86. The panel 84 is often substantially square or rectangular. The frame 86 can extend around all or a portion of a perimeter of the panel 84. For example, the frame 86 can extend along a front edge 90 of the panel 84 with the remaining portion of the perimeter of the panel 84 being free of a direct connection to the frame 86. The shelf 14, including the frame 86 and the panel 84, may include plastic materials, glass materials, metal materials, and/or combinations thereof.

The front edge 90 of the frame 86 is typically substantially linear. A rear edge 94 of the frame 86 often defines an indent 98 to accommodate an air delivery system 102 (FIG. 1) of a refrigeration system coupled to a rear panel 106 of the cabinet 18. However, it is also contemplated that the rear edge 94 of the shelf 14 may be linear based on the configuration of the refrigerator 22.

Referring still to FIGS. 2 and 3, the two-piece trim assembly 10 is coupled to at least the front edge 90 of the frame 86. In the embodiment illustrated in FIG. 2, the two-piece trim assembly 10 extends across the entire length of the front edge 90 of the frame 86. It is contemplated that the two-piece trim assembly 10 may extend a portion of the front edge 90 or along another edge of the frame 86 without departing from the teachings herein. Additionally or alternatively, it is contemplated that the two-piece trim assembly 10 may be coupled directly to the panel 84 of the shelf 14 in examples where the shelf 14 is free from the frame 86.

Figure 4:
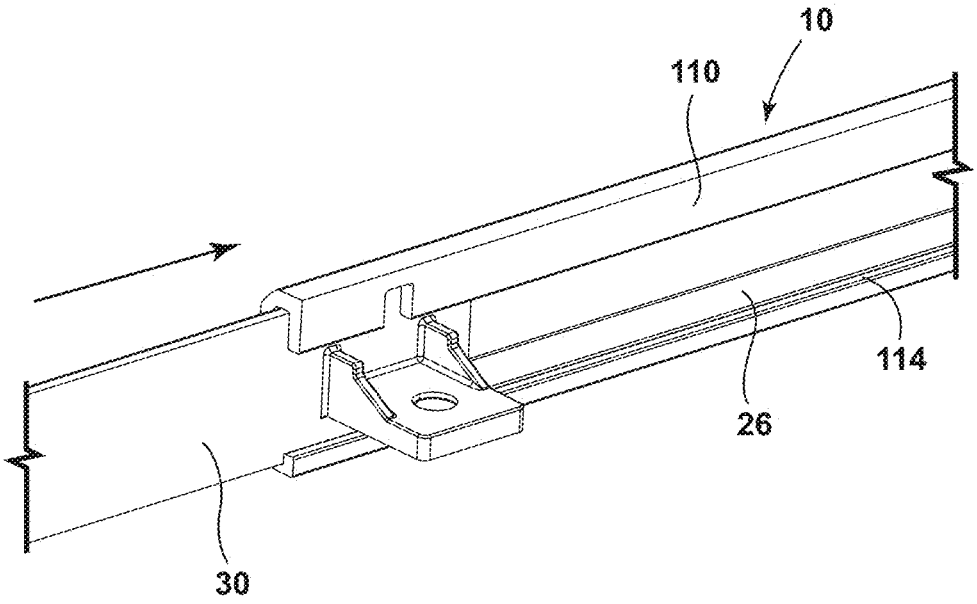
FIG. 4 is a partial side perspective view of an inner member and an outer member of the trim assembly, according to at least one example.

Referring to FIG. 4, the two-piece trim assembly 10 includes the outer member 26 and the inner member 30. The inner member 30 typically includes metal materials and the outer member 26 typically includes plastic materials. Alternatively, the outer member 26 may include metal materials and the inner member 30 may include plastic materials. The outer member 26 can have any design and include any material to provide the selected aesthetic for the two-piece trim assembly 10. Further, the inner member 30 can include any material configured to support the two-piece trim assembly 10 on the shelf 14.

Figure 5:
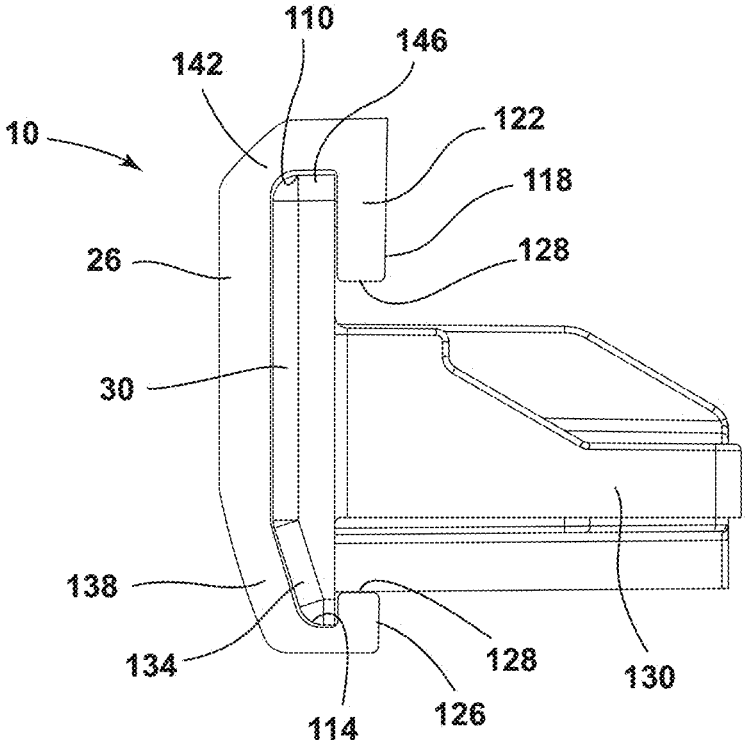
FIG. 5 is a side view of the inner member positioned within the outer member of the trim assembly, according to at least one example.

Typically, the outer member 26 defines an upper channel 110 and a lower groove 114 for slidably receiving the inner member 30 therein. The upper channel 110 and lower groove 114 operate as a track so the inner member 30 slides laterally along the upper channel 110 and lower groove 114. As illustrated in FIGS. 4 and 5, the lower groove 114 is typically shallower than the upper channel 110. In other words, the upper channel 110 typically has a height that is greater than a height of the lower groove 114. This configuration may be advantageous for securely retaining the outer member 26 on the inner member 30. Additionally, the upper channel 110 and the lower groove 114 cooperate to retain the inner member 30 within the outer member 26.

Referring to FIG. 5, the outer member 26 is substantially C-shaped to wrap around the inner member 30. When assembled, an inner portion 118 of the outer member 26 abuts a surface of the inner member 30 proximate a flange 130 of the inner member 30. Accordingly, the inner portion 118 includes a channel wall 122 that partially defines the upper channel 110. The inner portion 118 also includes a groove wall 126 that partially defines the lower groove 114. Accordingly, the channel wall 122 has a greater height than the groove wall 126. Edges 128 of each of the channel and groove walls 122, 126 of the inner portion 118 are spaced-apart from one another to accommodate the flange 130 extending from the inner member 30 therebetween, as well as the sliding engagement of the inner member 30 with the outer member 26.

In various examples, a bottom edge 134 of the inner member 30 and a lower edge 138 of the outer member 26 may be tapered. The tapered bottom and lower edges 134, 138 can operate to limit or restrict forward and backward movement of the inner member 30 when positioned within the outer member 26. The tapered bottom and lower edges 134, 138 typically extend an entire length of the outer and inner members 26, 30, respectively. Additionally or alternatively, an upper edge 142 of the outer member 26 and a top edge 146 of the inner member 30 may also be tapered, rounded, or may have an orthogonal orientation.

Figure 6:
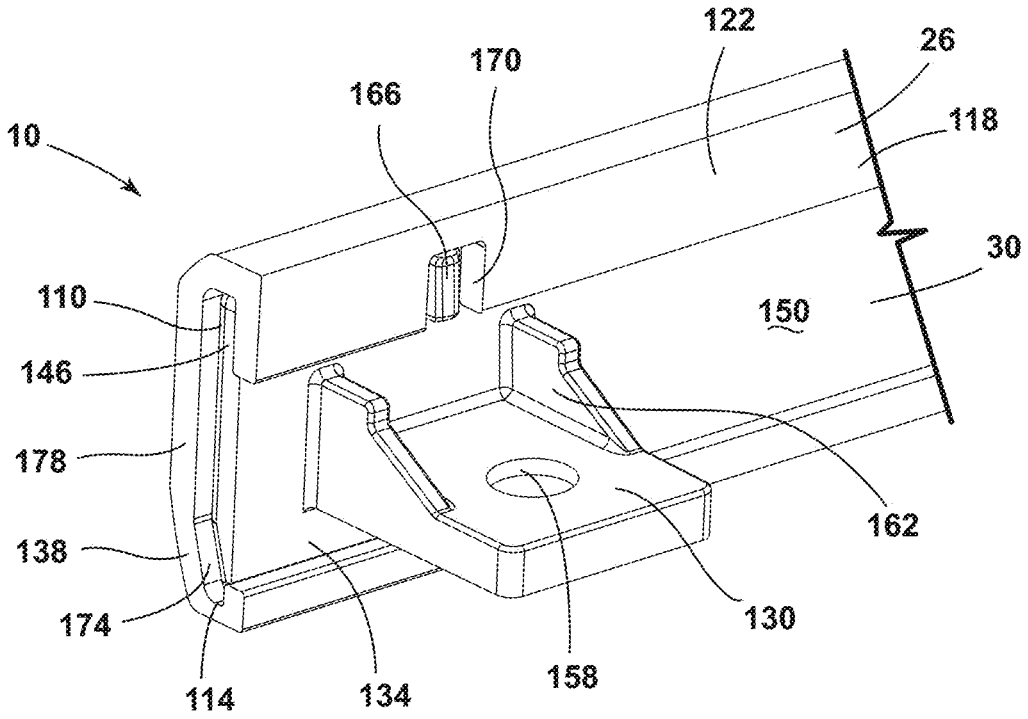
FIG. 6 is a partial side perspective view of the inner member positioned within the outer member of the trim assembly, according to at least one example.

Referring to FIGS. 5 and 6, the inner member 30 includes at least one flange 130 extending from an interior surface 150. In other words, the flange 130 extends from the inner member 30 between the channel and groove walls 122, 126 and away from the outer member 26. The flange 130 is configured to engage the shelf 14 (FIG. 2) to retain the two-piece trim assembly 10 on the shelf 14.

In various examples, the flange 130 defines an aperture 158 that is located on the flange 130. The flange 130 includes flange supports 162 extending vertically upwards from at least one side, and typically from opposing sides of the flange 130. The flange supports 162 are coupled to the interior surface 150 of the inner member 30. The flange supports 162 are advantageous to increase the strength and rigidity of the flange 130 and the interface between the flange 130 and the remainder of the inner member 30. Increased strength and rigidity of the flange 130 can provide greater stability in the connection between the two-piece trim assembly 10 and the shelf 14 (FIG. 2). The flange supports 162 are also advantageous to increase a contact area between the flange 130 and the interior surface 150 to increase the strength of the connection between the interior surface 150 of the inner member 30 and the flange 130.

Referring to FIG. 6, the inner member 30 includes at least one locking feature 166. The locking feature 166 may have a variety of configurations. The locking feature 166 is typically positioned proximate to the top edge 146 of the inner member 30, however, the locking feature 166 may extend from any practicable location on the interior surface 150 of the inner member 30 without departing from the teachings herein. The locking feature 166 can have a rounded shape. In various examples, the locking feature 166 may be, for example, a truncated frusto-conical shape, a truncated cylindrical shape, or a hemispherical shape. The rounded shape may be advantageous for sliding the locking feature 166 through the upper channel 110 of the outer member 26.

Figure 7:
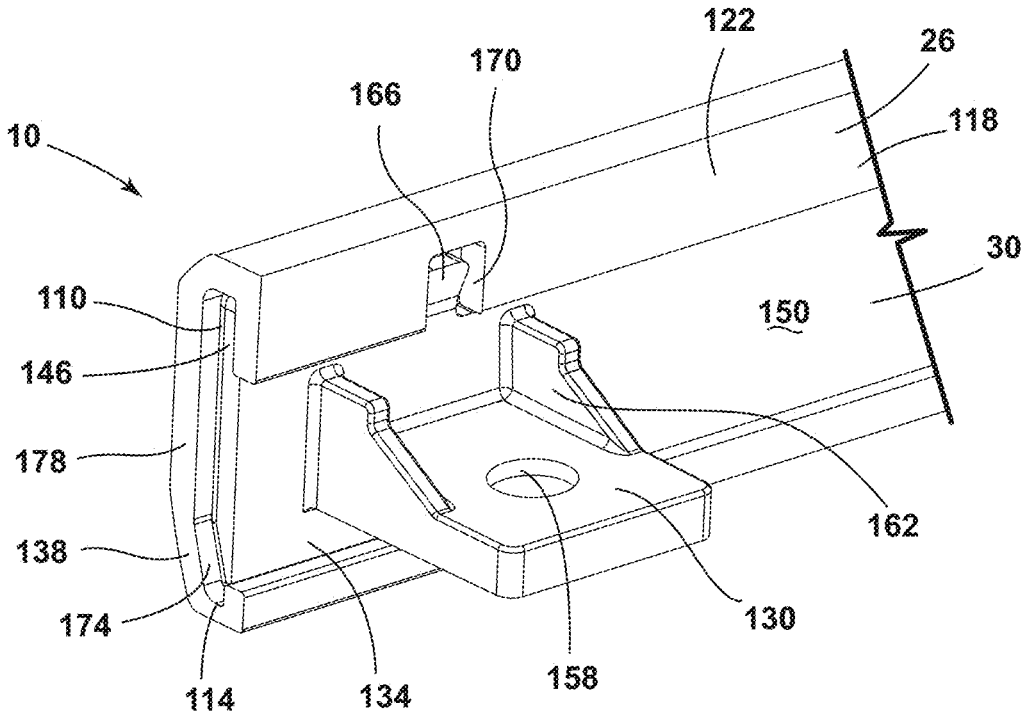
FIG. 7 is a partial side perspective view of the inner member positioned within the outer member of the trim assembly, according to at least one example.
Figure 8:
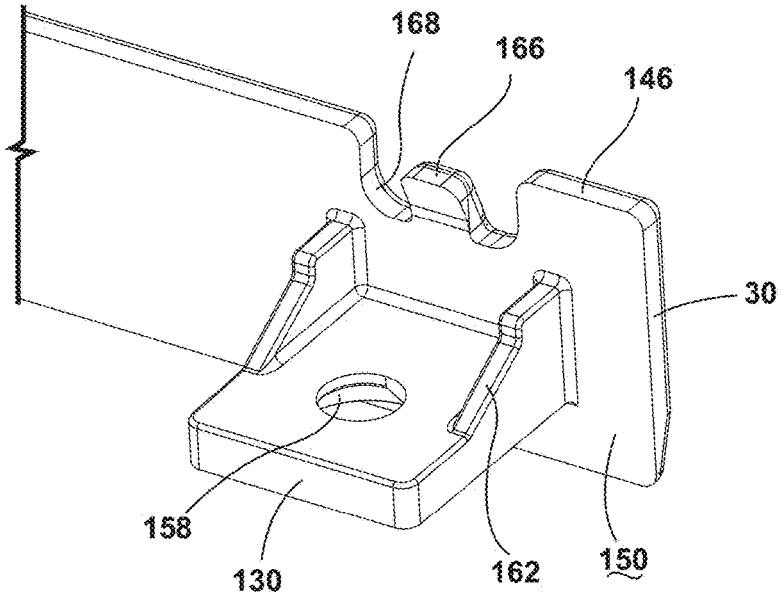
FIG. 8 is a partial side perspective view of the inner member having a locking feature, according to at least one example.

Referring to FIGS. 7 and 8, an additional or alternative non-limiting example of the locking feature 166 is illustrated. The locking feature 166 can be a tab or flange extending or biased at an oblique angle relative to the remainder of the inner member 30. The locking feature 166 can elastically deform as the locking feature 166 travels along the upper channel 110 and returns to the oblique angle, similar to a detent, when disposed within a notch 170 defined in the outer member 26. The inner member 30 can define an indent 168 in the top edge 146 and the locking feature 166 can be disposed within a space defined by the indent 168. This configuration can provide for the elastic deformation of the locking feature 166.

Referring again to FIGS. 6 and 7, the channel wall 122 of the outer member 26 typically defines the notch 170 for receiving the locking feature 166. The locking feature 166 cooperates with the notch 170 to retain the inner member 30 at a particular position within the outer member 26. The locking feature 166 is disposed within the notch 170 when the inner member 30 is fully disposed within the outer member 26 to form an interlocking connection therebetween. Additionally or alternatively, the locking feature 166 cooperates with the notch 170 to prevent and/or reduce side-to-side movement of the inner member 30 when positioned within the outer member 26. In various embodiments, the notch 170 has a substantially similar width as the width of the locking feature 166 to retain the locking feature 166 in a substantially same position and provide an interlocking fit. The shape and/or size of the notch 170 may be determined by the shape and/or size of the locking feature 166. It is contemplated that the locking feature 166 may be a detent, interlock, snap feature or can include other interlocking features.

The rounded locking feature 166 of FIG. 6 may also be advantageous for providing a stopping feature that limits or prevents additional movement of the inner member 26 and/or the outer member 30 in the direction of the component is slid to assemble the two-piece trim assembly 10. For example, the outer member 30 is slid in a first direction over the inner member 26, and when the locking feature 166 is disposed within the notch 170, the outer member 30 may not be moved further in the first direction. The locking feature 166 of FIG. 7 may provide a similar function, however, the locking feature 166 of FIG. 7 may also limit or prevent movement in a second opposing direction. For example, the outer member 30 may be slid in the first direction to assemble the two-piece trim assembly 10, and when the locking feature 166 is within the notch 170, the outer member 30 may not move further in the first direction or in the second opposing direction (e.g., to disassemble). Accordingly, the locking feature 166 may provide a stopping feature for assembling the two-piece trim assembly 10.

Figure 9:
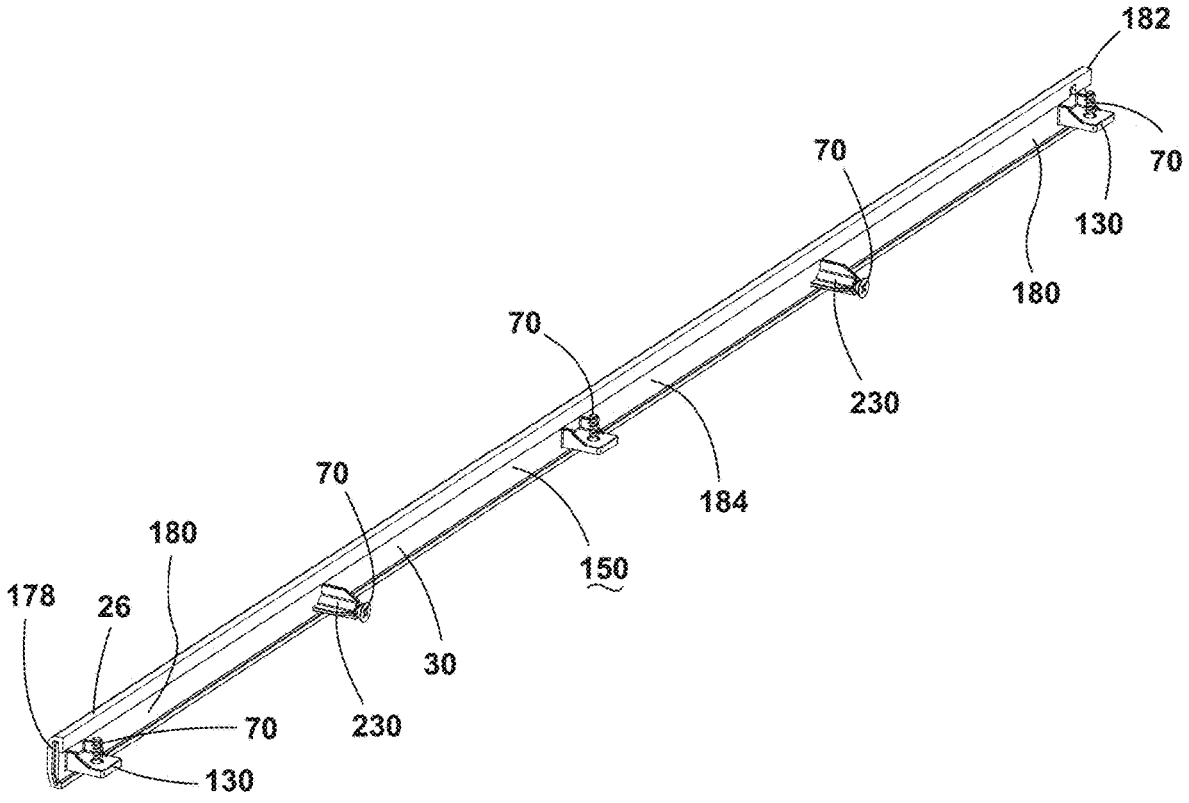
FIG. 9 is a side perspective view of the trim assembly, according to at least one example.

Referring to FIGS. 6, 7, and 9, the lower edge 138 of the outer member 26 can define a bumper 174. In various examples, at least one of left and right edges 178, 182 of the outer member 26 defines the bumper 174. The bumper 174 is advantageous for preventing and/or reducing side-to-side movement of the inner member 30 when the inner member 30 is positioned within the outer member 26. For example, the inner member 30 can be slid along the upper channel 110 and lower groove 114 until the inner member 30 contacts the bumper 174. In this way, the bumper 174 can stop the movement of the inner member 30 and/or the outer member 26 during assembly to provide proper alignment of the two-piece trim assembly 10. The bumper 174 may be an angled surface, where the angle is different than an angle and/or shape of the bottom edge 134 of the inner member 30.

Accordingly, the inner member 30 may be prevented from sliding over and/or past the bumper 174 when being assembled with the outer member 26. In examples where both the left and right edges 178, 182 of the outer member 26 define the bumper 174, the inner member 30 is configured to move over the bumpers 174 to be slidably received by the outer member 26. In examples where one of the left and right edges 178, 182 of the outer member 26 defines the bumper 174, the sliding assembly typically commences at the side without the bumper 174, allowing the bumper 174 to operate to stop movement of one or both of the inner member 30 and the outer member 26 upon full assembly.

Referring to FIG. 9, the inner member 30 typically includes more than one flange 130. The flanges 130 are spaced-apart at regular intervals along the length of the inner member 30. For example, flanges 130 can be disposed proximate each end of the inner member 30 on side edge portions 180 thereof and one flange 130 can be centrally located therebetween in a center portion 184 thereof. It is contemplated that the flanges 130 can be spaced-apart at irregular intervals or randomly along the length of the inner member 30. The spacing and arrangement of the flanges 130 may depend on the configuration of the shelf 14 (FIG. 2) to maximize the stability of the connection. Alternatively, the inner member 30 may include flanges 130 positioned on the side edge portions 180 of the inner member 30 and the central portion 184 of the inner member 30 may be free of any flanges 130.

Figure 10:
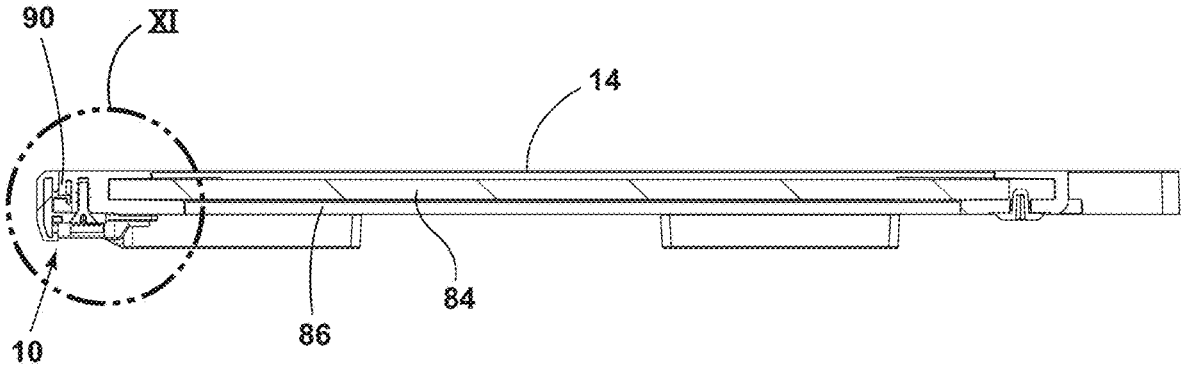
FIG. 10 is a cross-sectional view taken along line X-X of FIG. 2 of the shelf including the trim assembly, according to at least one example.

Referring to FIG. 10, the two-piece trim assembly 10 is coupled to the front edge 90 of the frame 86. It is also contemplated that if the shelf 14 is free of the frame 86. In such an aspect, the two-piece trim assembly 10 can be coupled to the panel 84. The two-piece trim assembly 10 is advantageous for providing a decorative element to the more visible front edge 90 of the shelf 14 to produce the desired aesthetic appearance to the shelf 14 and/or the appliance. Sturdier and more robust materials can then be utilized for the frame 86 and the panel 84.

Figure 11:
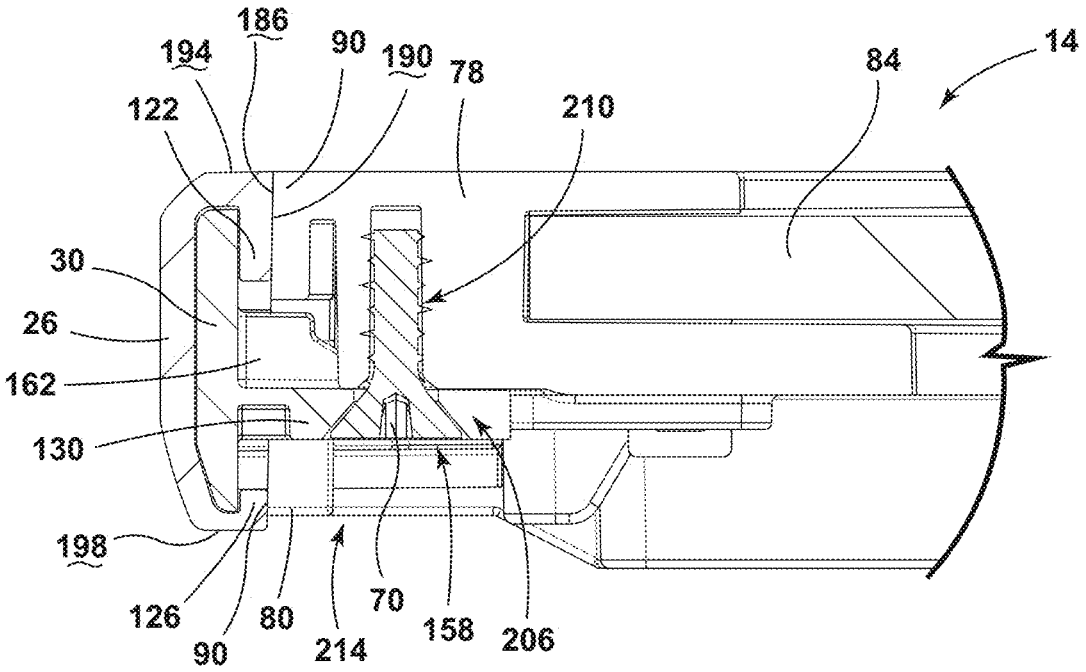
FIG. 11 is an enlarged cross-sectional view of FIG. 10, taken at area XI.

Referring to FIGS. 3 and 11, a surface 186 of each of the channel wall 122 and the groove wall 126 of the outer member 26 typically abuts a front surface 190 of the front edge 90 of the frame 86. An upper surface 194 of the outer member 26 may be aligned with the top surface 78 of the shelf 14. In such configurations, the two-piece trim assembly 10 may be an extension of the shelf 14. It is contemplated that the upper surface 194 may not be aligned, but may be offset from the top surface 78. In such examples, the two-piece trim assembly 10 can operate to retain items placed on the shelf 14. A lower surface 198 of the outer member 26 may extend past the bottom surface 80 of the shelf 14. However, it is contemplated that the lower surface 198 may align with the bottom surface 80 of the frame 86.

In various examples, the frame 86 can define a cavity 206 proximate the front edge 90 thereof. The cavity 206 may have more than one depth relative to the front surface 190 of the front edge 90. As illustrated in FIG. 11, the cavity 206 has a first depth to accommodate the flange 130 of the inner member 30 and a second lesser depth to accommodate the flange supports 162. The cavity 206 can be configured to receive one flange 130 or more than one flanges 130 of the inner member 30. Accordingly, the cavity 206 may be configured as multiple cavities 206 defined in discrete portions of the frame 86 or a single cavity 206 that may extend the length of the frame 86. The frame 86 can also define a frame boss 210 proximate to the cavity 206. The frame boss 210 is defined within the frame 86. In various examples, the frame boss 210 is an extension of the cavity 206, such that the cavity 206 and the frame boss 210 are in fluid communication. As illustrated, the cavity 206 extends a first direction into the frame 86 and the frame boss 210 extends a second direction in the frame 86. The second direction may be substantially perpendicular or oblique to the first direction. For example, the cavity 206 may extend substantially horizontal and the frame boss 210 extends substantially vertical. The number of frame bosses 210 may correspond to the number of cavities 206 defined by the frame 86 and/or the number of flanges 130.

When the flange 130 is positioned within the cavity 206, the frame boss 210 is aligned with the aperture 158 defined by the flange 130. As such, the frame boss 210 is typically spaced-apart from the front surface 190 of the frame 86. The bottom surface 80 of the shelf 14 defines an opening 214 vertically aligned with the frame boss 210. The two-piece trim assembly 10 is coupled to the frame 86 via at least one fastener 70. The fastener 70 is configured to extend through the aperture 158 of the flange 130 and into the frame boss 210 defined by the frame 86. The opening 214 defined by the bottom surface 80 of the frame 86 is advantageous for inserting the fastener 70 into the frame boss 210. The opening 214 is also advantageous for accessing the fastener 70 to remove the two-piece trim assembly 10 from the shelf 14. The fastener 70 may be, for example, a pin, bolt, screw, nail, or other coupling members. Additionally or alternatively, the flange 130 can abut the bottom surface 80 of the shelf 14, which can provide access to the aperture 158 and the frame boss 210.

Referring to FIGS. 1-11, the outer and inner members 26, 30 are typically coupled together before the two-piece trim assembly 10 is coupled to the frame 86. In such examples, the outer member 26 is slidably engaged over the inner member 30. The flanges 130 of the inner member 30 are then aligned with the cavities 206 defined by the frame 86 and inserted therein. Additionally or alternatively, the flanges 130 are aligned with the frame bosses 210 and abut the bottom surface 80 of the shelf 14. The fasteners 70 are then inserted through the apertures 158 of the flanges 130, respectively, and into the frame bosses 210 to couple the inner member 30 to the shelf 14.

In another non-limiting example, the inner member 30 can be coupled to the shelf 14 before being coupled to the outer member 26. In such examples, the flanges 130 are aligned with the frame bosses 210 of the frame 86. The fasteners 70 can then be inserted through the apertures 158 of the flanges 130 and into the frame bosses 210, respectively. The outer member 26 is then slidably received by the inner member 30.

Figure 12:
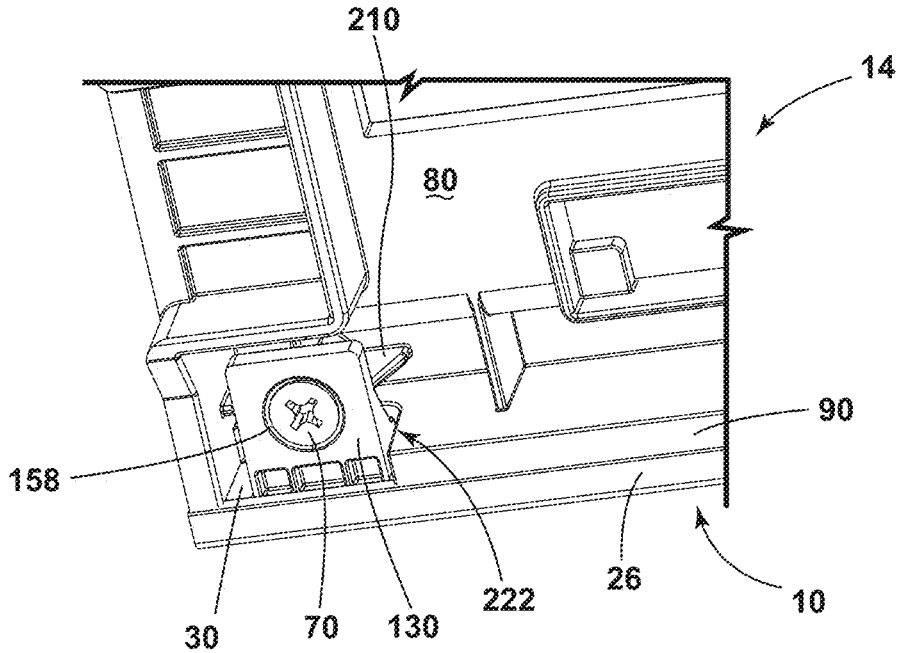
FIG. 12 is a partial bottom perspective view of the trim assembly coupled to a bottom surface of a shelf body of the shelf, according to at least one example.

Referring to FIGS. 3 and 12, in another exemplary embodiment, the front edge 90 of the frame 86 defines at least one cutout 222. The size and/or shape of the cutout 222 is configured to correspond with the size and/or shape of the flange 130 of the inner member 30. In such examples, the bottom surface 80 of the frame 86 defines the frame bosses 210. The frame bosses 210 are configured to project from the bottom surface 80 of the frame 86. The frame bosses 210 are configured to align with the apertures 158 defined by the flanges 130, respectively, when the flanges 130 are positioned within the cutouts 222. Typically, the frame bosses 210 are disposed behind the front edge 90 of the frame 86 and substantially obscured from view. The fasteners 70 are then inserted through the apertures 158 and into the frame bosses 210. The inner member 30 may be coupled to the outer member 26 and then coupled to the frame 86. Additionally or alternatively, the inner member 30 may be coupled to the frame 86 and then the outer member 26 may be slidably coupled to the inner member 30.

Figure 13:
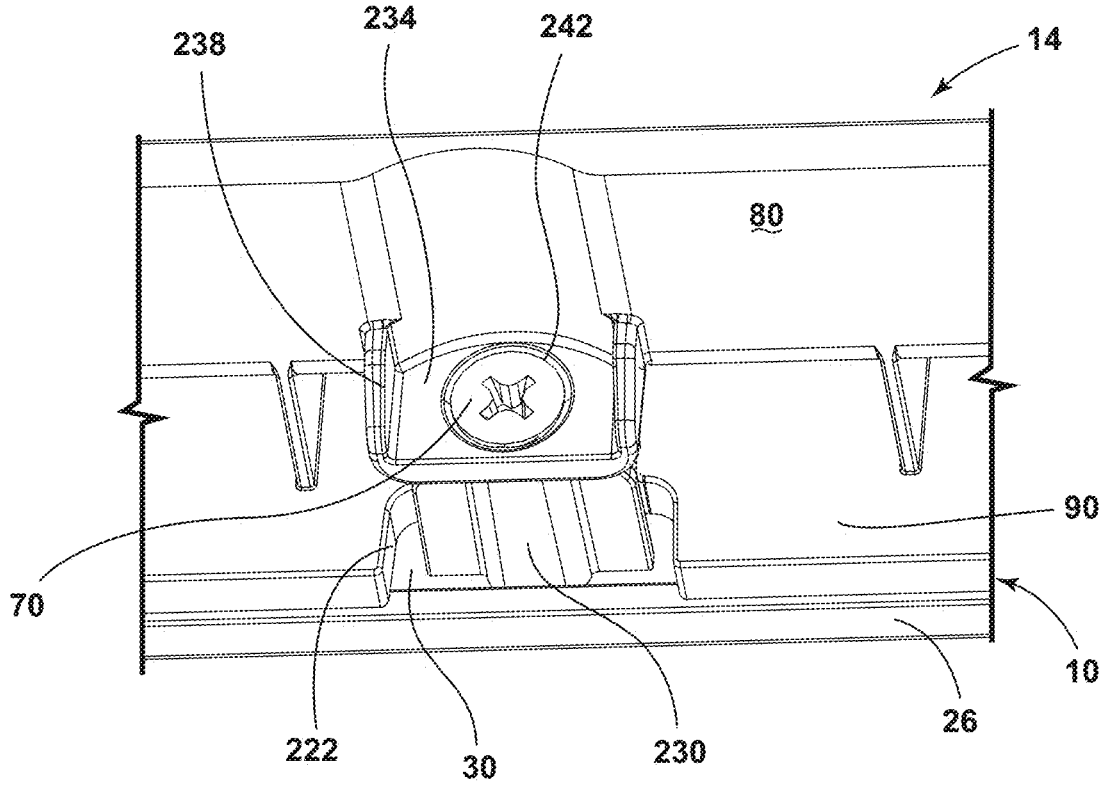
FIG. 13 is a partial bottom perspective view of the trim assembly coupled to the bottom surface of the shelf body of the shelf, according to at least one example.

Referring to FIGS. 3, 9, and 13, in another exemplary embodiment, the inner member 30 includes trim bosses 230. The trim bosses 230 may be in addition to or in replacement of the flanges 130 (FIG. 12). For example, the inner member 30 can include one or more trim bosses 230 between adjacent flanges 130. In such examples, the bottom surface 80 of the frame 86 includes tabs 234 extending downward from the bottom surface 80 proximate to the front edge 90. The front edge 90 can substantially obscure the tabs 234 from view. The tabs 234 may each include a curved rim 238 for adding strength to the tabs 234 and increasing the size of the attachment to the bottom surface 80. The tabs 234 each define a receiving hole 242 centrally located therein. The cutouts 222 defined by the front edge 90 of the frame 86 may correspond to the size and/or shape of the trim bosses 230.

The receiving hole 242 of the tabs 234 are configured to align with the trim bosses 230 when the trim bosses 230 are positioned within the cutouts 222. The fasteners 70 extend through the receiving hole 242 of the tabs 234 of the frame 86 and into the trim bosses 230 of the inner member 30. The inner member 30 may be coupled to the outer member 26 and then coupled to the frame 86. Additionally or alternatively, the inner member 30 may be coupled to the shelf 14 and then the outer member 26 may be slidably coupled to the inner member 30. The frame 86 can define cutouts 222 of various shapes and sizes. For example, the frame 86 can define a first cutout 222 to correspond with the flanges 130 and a second cutout 222 to correspond with the trim bosses 230.

It is contemplated that in examples of the shelves 14 without the frame 86, the panel 84 can include and/or define the various features discussed herein to receive and retain the two-piece trim assembly 10.

Referring to FIGS. 3, 6, 12, and 13, the two-piece trim assembly 10 and the shelf 14 typically have two types of connections. For example, there is a connection between the flanges 130 and the frame bosses 210 and another connection between the trim bosses 230 and the tabs 234. The connection between the flanges 130 and frame bosses 210 can retain the two-piece trim assembly 10 to the frame 86 and limit movement therebetween. The fasteners 70 extend substantially vertically between the flanges 130 and the frame bosses 210.

The connection between the trim bosses 230 and the tabs 234 can limit movement between the two-piece trim assembly 10 and the frame 86. The fasteners 70 can extend substantially horizontally between the trim bosses 230 and the tabs 234. In this way, the connection limits movement between the two-piece trim assembly 10 and the frame 86. Accordingly, the fasteners 70 coupling the flanges 130 to the frame bosses 210 typically extend in a first direction and the fasteners 70 coupling the trim bosses 230 to the tabs 234 typically extend in a second direction, perpendicular to the first direction. The two directions of the fasteners 70 can provide increased strength and stability to the two-piece trim assembly 10 and the attachment of the shelf 14.

Use of the present disclosure provides for a variety of advantages. For example, conventional trim features may require adhesive for coupling the trim feature to a shelf. The two-piece trim assembly 10 disclosed herein is mechanically fastened to the frame 86. The mechanical fastening can decrease manufacturing and production costs. Additionally, the mechanical fastening typically results in increased durability of the attachment between the two-piece trim assembly 10 and the frame 86. Also, the two-piece trim assembly 10 has increased stability. The connections between the frame 86 and the two-piece trim assembly 10 are disposed within or beneath the frame 86. Further, two types of connections between the two-piece trim assembly 10 and the shelf 14 provide for greater stability. Moreover, the surface 186 of the inner portion 118 of the outer member 26 abuts the front surface 190 of the shelf 14 allowing for more stability. Further, the two-piece trim assembly 10 as disclosed herein provides for more efficient changes to the two-piece trim assembly 10 with a reduced effect on the manufacturing process. Similarly, a user may interchange the two-piece trim assembly 10 more efficiently. Additional benefits and advantages of using this device may also be realized and/or achieved.

According to one aspect of the present disclosure, an appliance includes a cabinet that has an inner surface. A frame is coupled to the inner surface of the cabinet. The frame includes a frame boss that extends from a bottom surface thereof. A panel is positioned within the frame. The frame extends along a perimeter of the panel. An inner trim member has a flange that extends therefrom. The flange defines an aperture configured to align with the frame boss. A fastener is configured to extend through the aperture and engage the frame boss to couple the inner trim member with the frame. An outer trim member is disposed over the inner trim member. The inner trim member is configured to slidably receive the outer trim member.

According to another aspect, a frame includes a tab that extends from a bottom surface thereof. The tab defines a receiving hole.

According to another aspect, an inner trim member defines a trim boss that extends therefrom. The trim boss is configured to align with a receiving hole of a tab to receive a fastener.

According to another aspect, a lower edge of an outer trim member tapers to retain an inner trim member.

According to another aspect, an inner trim member defines a locking feature configured to interlock with an outer trim member.

According to another aspect, a frame defines a cavity for receiving a flange. The frame defines a frame boss in fluid communication with the cavity for receiving a fastener.

According to another aspect, an end of an outer trim member defines a bumper proximate a lower groove to retain an inner trim member.

According to another aspect of the present disclosure, a shelf assembly for an appliance includes a panel that has a first edge. A frame extends along at least the first edge. The frame defines a first cutout and a second cutout spaced-apart from one another. An inner trim member is coupled to the frame. The inner trim member includes a flange configured to extend through the first cutout and a trim boss configured to extend through the second cutout. An outer trim member is configured to be slidably received by the inner trim member.

According to another aspect, a frame defines a frame boss that extends from a bottom surface thereof proximate a first cutout.

According to another aspect, a flange defines an aperture. A frame boss is configured to align with the aperture to receive a fastener.

According to another aspect, a frame defines a tab that extends from a bottom surface thereof proximate a second cutout.

According to another aspect, a tab defines a receiving hole. A trim boss is configured to align with the receiving hole to receive a fastener.

According to another aspect, an outer trim member defines an upper channel and a lower groove. An inner trim member is configured to slidably engage the upper channel and the lower groove.

According to another aspect, a first fastener is engaged with a flange. A second fastener is engaged with a trim boss. The first fastener is disposed in a first direction and the second fastener is disposed in a second direction perpendicular to the first direction.

According to another aspect of the present disclosure, a trim assembly for a shelf includes an inner member that defines a trim boss that extends therefrom. The inner member defines a locking feature. An outer member is configured to be slidably received by the inner member. The outer member defines a notch. The locking feature is configured to form an interlocking connection with the outer member when disposed within the notch. A frame defines a cutout. The trim boss is disposed in the cutout.

According to another aspect, an inner portion of an outer trim member abuts a first edge of the frame.

According to another aspect, an outer member includes a bumper disposed at an end thereof to retain an inner member.

According to another aspect, an outer member includes an upper channel and a lower groove to slidably receive an inner member.

According to another aspect, a frame includes a tab extending from a bottom surface thereof. The tab is configured to engage with the trim boss.

According to another aspect, a frame includes a frame boss that extends from a bottom surface thereof. The frame boss is configured to engage with a flange defined by an inner member.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance shelf assembly, comprising:

a panel;

a frame coupled to at least one edge of the panel, wherein the frame includes a tab defining a receiving hole and a frame boss; and a trim assembly coupled to the frame, wherein the trim assembly includes:

an inner trim member having a flange and a trim boss, wherein the flange defines an aperture that is configured to align with the frame boss to receive a first fastener, and wherein the trim boss is configured to align with the receiving hole of the tab to receive a second fastener; and an outer trim member slidably engaged with the inner trim member.

2. The appliance shelf assembly of claim 1, wherein the frame boss extends from a bottom surface of the frame to engage the flange.

3. The appliance shelf assembly of claim 1, wherein the frame boss is defined in the frame, and wherein the frame defines a cavity to receive the flange to align the flange with the frame boss.

4. The appliance shelf assembly of claim 1, wherein the outer trim member extends along an outer surface and a portion of an interior surface of the inner trim member.

5. The appliance shelf assembly of claim 1, wherein the outer trim member defines a notch to receive a locking feature of the inner trim member.

6. The appliance shelf assembly of claim 1, wherein the frame extends along each edge of the panel, and wherein the trim assembly extends along a front edge of the frame.

7. The appliance shelf assembly of claim 1, wherein a bottom edge of the inner trim member is tapered and a lower edge of the outer trim member is tapered.

8. A shelf assembly for an appliance, comprising:

a panel having a first edge;

a frame extending along at least the first edge, wherein the frame defines a first cutout and a second cutout spaced-apart from one another, wherein the frame includes a frame boss and a tab;

an inner trim member coupled to the frame, wherein the inner trim member includes a flange configured to extend through the first cutout to engage the frame boss and a trim boss configured to extend through the second cutout to engage the tab; and an outer trim member configured to be slidably received by the inner trim member.

9. The shelf assembly of claim 8, wherein the frame boss extends from a bottom surface of the frame proximate the first cutout.

10. The shelf assembly of claim 8, wherein the flange defines an aperture configured to align with the frame boss to receive a fastener.

11. The shelf assembly of claim 8, wherein the tab extends from a bottom surface of the frame proximate the second cutout.

12. The shelf assembly of claim 8, wherein the tab defines a receiving hole configured to align with the trim boss to receive a fastener.

13. The shelf assembly of claim 8, wherein the outer trim member defines an upper channel and a lower groove, and wherein the inner trim member is configured to slidably engage the upper channel and the lower groove.

14. The shelf assembly of claim 8, further comprising:

a first fastener engaged with the flange; and a second fastener engaged with the trim boss, wherein the first fastener is disposed in a first direction and the second fastener is disposed in a second direction perpendicular to the first direction.

* * * * *